US005122247A

United States Patent [19]

Kokado et al.

[11] Patent Number: 5,122,247

[45] Date of Patent: Jun. 16, 1992

[54] PROCESS FOR PRODUCING THIN FILMS

[75] Inventors: Hiroshi Kokado; Katsuyoshi Hoshino; Tetsuo Saji, all of Tokyo; Seiichiro Yokoyama, Sodegaura, all of Japan

[73] Assignee: Idemitsu Kosan Co., Ltd., Tokyo, Japan

[21] Appl. No.: 444,817

[22] Filed: Dec. 1, 1989

[30] Foreign Application Priority Data

Dec. 17, 1988 [JP] Japan ..... 63-317627
Dec. 17, 1988 [JP] Japan ..... 63-3176626
May 12, 1989 [JP] Japan ..... 1-117481

[51] Int. Cl.[5] ..... C25D 13/00

[52] U.S. Cl. ..... 204/181.1; 204/181.7; 204/299 EC; 204/180.2; 430/57; 430/58; 430/127; 430/132

[58] Field of Search ..... 204/181.1, 181.7, 299 EC, 204/180.2; 430/57, 58, 127, 132, 133, 134

[56] References Cited

U.S. PATENT DOCUMENTS 3,971,708 7/1976 Davis et al. ..... 204/180.8
4,122,217 10/1978 Sturwold et al. ..... 427/156
4,343,885 8/1982 Reardon, Jr. ..... 430/177
4,345,004 8/1982 Miyata et al. ..... 204/181.1
4,460,439 7/1984 Barlow et al. ..... 204/181.7
4,655,787 4/1987 Renton ..... 204/181.1
4,839,322 6/1989 Yodice ..... 204/59 R
4,999,094 3/1991 Kamamori et al. ..... 204/181.7 X
5,015,748 5/1991 Eida et al. ..... 556/144
5,041,582 8/1991 Eida et al. ..... 556/143
5,082,539 1/1992 Saji et al. ..... 205/162

FOREIGN PATENT DOCUMENTS 0331745 9/1989 European Pat. Off. .
WO88/07538 10/1988 World Int. Prop. O. .

OTHER PUBLICATIONS

T. Saji: "Electrochemical formation of a phthalocyanine thin film by disruption of micellar aggregates", Apr. 1988, pp. 693-696, The Chemical Society of Japan, Chemistry Letters, No. 4.

K. Hoshino et al: "Electrochemical formation of an organic thin film by disruption of micelles", pp. 5881-5883, American Chemical Society; J. Am. Chem. Soc., vol. 109, 1987.

*Primary Examiner*—John Niebling
*Assistant Examiner*—Arun S. Phasge
*Attorney, Agent, or Firm*—Frishauf, Holtz, Goodman & Woodward

[57] ABSTRACT

By electrotreating a dispersion or solution obtained by dispersing or dissolving hydrophobic substance powder in aqueous medium with the use of surfactant having a HLB value of 10.0 to 20.0, under the conditions for forming the thin film of said hydrophobic substance on the cathode, thin films of hydrophobic substance is formed on the cathode. In this way thin films of hydrophobic substance can be formed on base metals such as aluminum, which can be applied to photosensitive materials and the like.

21 Claims, 9 Drawing Sheets

PROCESS FOR PRODUCING THIN FILMS

BACKGROUND OF THE INVENTION

1. Field of the Invention

The present invention relates to a process for producing thin films, and more particularly to a process for efficiently producing thin films which tightly stick to cathodes consisting of base metals such as aluminum and the like.

2. Description of the Related Arts

For producing thin films including coloring matter, there have heretofore been known the vacuum deposition method, the heat CVD method, the plasma CVD method, the ultrahigh vacuum (ion beam, molecular beam epitaxy) method, the LB membrane method and the casting method.

These methods, however, require the operations of dissolving the starting material such as coloring matters in organic solvents or heating them, so it has been impossible to form hydrophobic substances having little resistance to heat, into thin films.

Recently, there have been developed the processes for forming thin films of various hydrophobic organic substances by use of so called Micellar Disruption Method (Electrochemistry Society, 54th Spring Convention F 201, 1987)(Japanese Patent Application Laid-Open No. 243298/1988).

According to said Micellar Disruption Method, thin films of various hydrophobic substances can be efficiently produced, and said method has attracted attention as an industrially advantageous process. Thin films produced in this way are projected for various uses such as color filters, photoelectric transformation materials and the like.

According to the process disclosed here, however, though thin films can be formed on an anode, it has been very difficult to form films on base metals which dissolve easily by positive polarization.

On the other hand, in the field of photosensitive materials, film forming on the substrates of base metals such as aluminum has been desired, and a process for producing thin films that stick tightly to base metals are expected to be developed.

SUMMARY OF THE INVENTION

The object of the present invention is to provide a process for forming thin films which are uniform and tightly stick to base metals.

Another object of the present invention is to provide a process for efficiently producing an excellent photoconductor for electrophotography.

The present invention provides a process for producing a thin film, characterized by electrotreating a dispersion or solution obtained by dispersing or dissolving hydrophobic substance powder in an aqueous medium with a surfactant having a HLB value of 10.0 to 20.0 under the conditions for forming thin films of the above mentioned hydrophobic substances on a cathode.

Therein, by forming thin films with the use of an aluminum electrode as the cathode, a photoconductor for electrophotography having excellent properties can be obtained.

DESCRIPTION OF PREFERRED EMBODIMENTS

Figure 1:
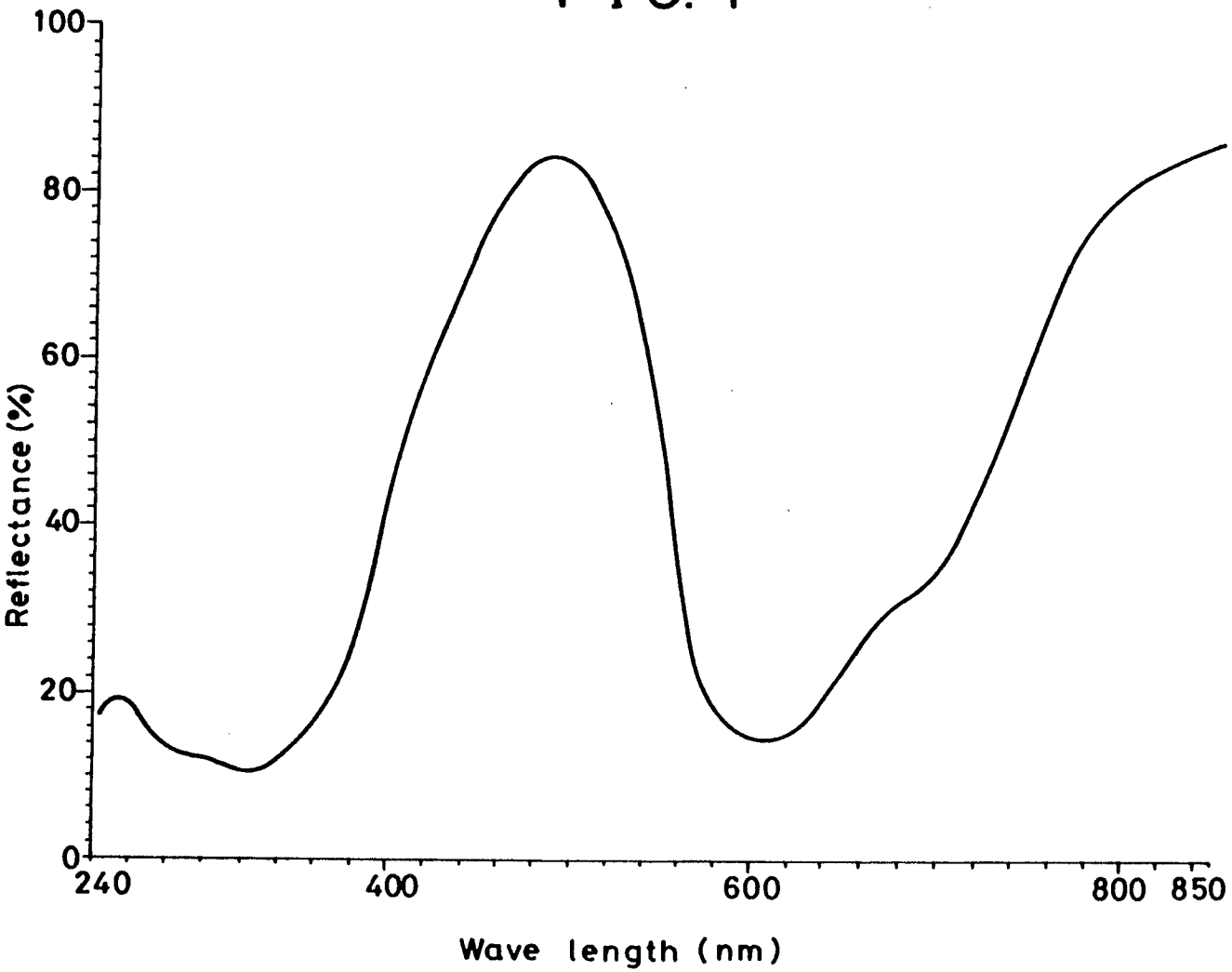
FIGS. 1 to 9 are graphs each illustrating the reflection peak of visible rays irradiated onto the aluminum substrate with the thin film formed in Examples 1 to 9, respectively.

In the process of the present invention, a hydrophobic substance powder is applied as the material of thin films. The average particle diameter of said hydrophobic substance powder is preferably not more than 10 μm, particularly 1 to 0.01 μm. If the average particle diameter is in excess of 10 μm, there may be caused various disadvantages that it takes much time to disperse or dissolve the powder in aqueous medium or it is difficult to disperse or dissolve the powder homogeneously.

The kind of said hydrophobic substance powder may be selected properly according to the uses of thin films to be formed, and various ones can be used irrespective of the organic substance or the inorganic substance. Examples of them are coloring matters for optical memory and organic coloring matters such as perylene, indigo, thioindigo, squalilium, dichlorobenzene, thiapyrylium, azo-type coloring matter, quinacridone, viologen, Sudan, lake pigment, phthalocyanine blue, photalocyanine green, anthracene, anthraquinone, phthalocyanine, metal complexes of phthalocyanine, derivatives thereof, porphyrin, metal.complexes of porphyrin, and derivatives thereof: electrochromic materials such as 1,1'-diheptyl-4,4'-bipyridinium dibromide, 1,1'-didodecyl-4,4'-bipyridinium dibromide and the like, light sensitive materials (photochromic materials) and light sensor materials such as 6-nitro-1,3,3-trimethylspiro-(2'H-1'-benzopyran-2,2'-indoline) (commonly called spiropyran) and the like; liquid crystal display coloring matters such as p-azoxyanisole and the like. Further examples are the hydrophobic compounds among the coloring matters each for electronics, recording, photo-chromism, photos, energy use, biomedicals, and coloring matters for food and cosmetics, dyes, coloring matters for specific coloring which are listed in "Color Chemical Cyclopedia", CMC Co., Ltd., pp 542–717, Mar. 28, 1988. Particularly preferred among the above are metal complexes and derivatives of phthalocyanine (Pc), specifically X-type and $\tau$-type $H_2$-Pc, $\epsilon$-type, Cu-Pc, VO-Pc, InCl-Pc, AlCl-Pc, $\alpha$-type TiO-Pc, Mg-Pc and the like. Moreover, electrically conductive organic materials and gas sensor materials such as the 1:1 complex of 7,7,8,8-tetra-cyanoquinonedimethane (TCNQ) and tetrathiafulvalene (TTF), light curing paints such as pentaerythritol diacrylate and the like, diazo-type light sensitive materials and paints such as 1-phenylazo-2-naphthol and the like can be used. Furthermore, water-insoluble polymers including general purpose polymers such as polycarbonate, polystyrene, polyethylene, polypropylene, polyamide, polyphenylene sulfide (PPS), polyphenylene oxide (PPO), polyacrylonitrile (PAN) and the like; polyphenylene, polypyrrole, polyaniline, polythiophene, acetyl cellulose, poly(vinyl acetate), poly(vinyl butyral), and various polymers (poly(vinyl pyridine) and the like) and copolymers (copolymer of methyl methacrylate and methacrylic acid and the like) can be used.

The inorganic hydrophobic substances therein may extend to those of various kinds in various manners, including $TiO_2$, C, CdS, $WO_3$, $Fe_2O_3$, $Y_2O_3$, $ZrO_2$, $Al_2O_3$, CuS, ZnS, $TeO_2$, $LiNb_3O$, $Si_3N_4$ and the like, and various kinds of superconductive oxides. Particularly by employing charge carrier generation materials (CGM) as said hydrophobic substance, preferable thin films as said photoconductor for electrophotography can be obtained.

As the aqueous medium to be used in the present invention, various media such as water, mixtures of water and alcohol, mixture of water and acetone, and the like can be used.

On the other hand, surfactants used in the present invention are the surfactants having a HLB value of 10.0 to 20.0, preferably 12 to 18. Preferred examples of such surfactants are non-ionic surfactants such as polyoxyethylene alkylether, polyoxyethylene fatty acid ester, polyoxyethylene alkylphenylether, polyoxyethylene polyoxypropylene alkylether and the like. In addition, alkyl sulfates, polyoxyethylene alkylether sulfates, alkyltrimethylammonium chloride, fatty acid diethylaminoethyl amide and the like can also be used.

As the surfactants, ferrocene derivatives can be also used. Said ferrocene derivatives include various kinds. Representative examples of them are ferrocene derivatives represented by the general formula:

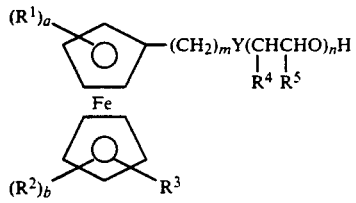

(I)

wherein, $R^1$ and $R^2$ are each an alkyl group having not more than 6 carbon atoms, an alkoxyl group having not more than 6 carbon atoms, an amino group, a dimethylamino group, a hydroxyl group, an acetyl amino group, a carboxyl group, a methoxycarbonyl group, an acetoxyl group, an aldehyde group and a halogen, $R^3$ indicates a hydrogen or a straight chain or branched alkyl group or alkenyl group having 4 to 18 carbon atoms, and $R^4$ and $R^5$ indicate each a hydrogen or a methyl group. Y indicates an oxygen or an oxycarbonyl group, a is an integer of 0 to 4, b is an integer of 0 to 4, m is an integer of 1 to 18, and n is a real number of 2.0 to 70.0. Therein each symbol in general formula (I) is as defined before. As described in International Patent Publication W088/07538, W089/01939, Japanese Patent Application No. 33797/1988 and others, $R^1$ and $R^2$ are each an alkyl group (a methyl group ($CH_3$), an ethyl group ($C_2H_5$), etc.), an alkoxyl group (a methoxyl group ($OCH_3$), an ethoxyl group ($OC_2H_5$), etc.), an amino group ($NH_2$), a dimethylamino group ($N(CH_3)_2$), a hydroxyl group (OH), an acetylamino group ($NHCOCH_3$), a carboxyl group (COOH), an acetoxyl group ($OCOCH_3$), a methoxycarbonyl group ($COOCH_3$), an aldehyde group (CHO) or a halogen (a chlorine, a bromine, a fluorine, an iodine, etc.) $R^1$ and $R^2$ may be identical or different, and in case plural $R^1$s and $R^2$s exist in five-membered ring of ferrocene, plural substituents may be identical or different. $R^3$ indicates a hydrocarbon or a straight chain or a branched alkyl group or alkenyl group having 4 to 18 carbons.

Further, Y indicates an oxygen (—O—) or an oxycarbonyl group (—C—O—), and $R^4$ and $R^5$ are each a hydrogen or a methyl group ($CH_3$). Accordingly, $$-Y-(\underset{R^4}{\underset{|}{C}}H\underset{R^5}{\underset{|}{C}}OH-)_nH \text{ is}$$

-continued $$-O(CH_2CH_2O)_nH.$$

$$-O(CH_2\underset{CH_3}{\underset{|}{C}}HO)_nH,\quad -O(\underset{CH_3}{\underset{|}{C}}HCH_2O)_nH.$$

$$-\underset{O}{\underset{\|}{C}}-O(CH_2CH_2O)_nH$$

$$-\underset{O}{\underset{\|}{C}}-O(CH_2\underset{CH_3}{\underset{|}{C}}HO)_nH,\quad -\underset{O}{\underset{\|}{C}}-O(\underset{CH_3}{\underset{|}{C}}HCH_2O)_nH$$

or the like.

m indicates an integer of 1 to 18. Accordingly, between the ring member carbon atoms and the above described oxygen or an oxycarbonyl group, an alkylene group having 1 to 18 carbon atoms such as an ethylene group, a propylene group and the like is interposed. Further, it indicates the repeating number of above described oxyalkylene group including oxyethylene group and the like, and means not only integers, but also real number including them in the range of 2.0 to 70.0, showing the mean value of the repeating number of oxyalkylene group and the like.

In addition to the ferrocene derivatives represented by the above general formula (I), various ones including ammonium type and pyrridine type (International Patent Publication W088/07538, etc.) can be used in the present invention. And further examples are the ferrocene derivatives described in the specifications of Japanese Patent Application Nos. 233797/1988, 233798/1988, 248600/1988, 248601/1988, 45370/1989, 54956/1989, 70680/1989, 70681/1989, 76498/1989 and 74699/1989.

These ferrocene derivatives can very efficiently dissolve or disperse hydrophobic substances into aqueous medium.

In the process of the present invention, one of the above surfactants and hydrophobic substance powder are added in an aqueous medium, and the mixture is stirred fully by the use of ultrasonic waves, a homogenizer or a stirrer for 1 hour to 7 days. By this operation, the hydrophobic substance powder is homogeneously dispersed or dissolved in the aqueous medium by the function of a surfactant having a HLB value of 10.0 to 20.0.

In the present invention, to the homogeneous dispersion or aqueous solution thus obtained, supporting salts are added if desired, or excessive hydrophobic substances are removed by centrifugation, decantation, static sedimentation or other ways according to the circumstances, and the resulting electrolyte is subjected to an electrotreatment while allowing the dispersion or solution to stand or to subject the same to stirring. During the electrotreatment, hydrophobic substance powder may be supplementarily added to the electrolyte, or there may be provided a recycle circuit in which a part of the electrolyte is withdrawn out of the system, the inorganic substance is added to the withdrawn electrolyte and thoroughly stirred, and then the resulting solution is returned to the system.

The concentration of the surfactant in that process is not critical, but is usually selected in the range of 10 $\mu$M to 1M, preferably 0.5 mM to 5 mM. In the case wherein various ferrocene derivatives (micelle forming agent) including ferrocene derivatives of the above described general formula (I) are used as surfactants, the concentration of it should be the threshold micelle concentration or higher.

The supporting salt is added, if necessary, in order to control the electrical conductance of the aqueous medium. The amount of the supporting salt added is not critical, as long as it does not inhibit the deposition of the hydrophobic substance dissolved or dispersed in the solution, but it is usually about 0 to 300 times and preferably about 10 to 200 times that of the above surfactant. Said supporting salt is not necessarily needed for electrotreatment. Without it, a film of high purity containing no supporting salt can be obtained. The type of supporting salt is not critical as long as it is able to control the electric conductance for the aqueous medium without inhibiting the dissolving or deposition of the above described hydrophobic substance onto the electrode.

Preferred examples of the supporting salts are specifically, sulfuric acid salts (salts of lithium, potassium, sodium, rubidium, aluminum and the like), acetic acid salts (salts of lithium, potassium, sodium, rubidium, beryllium, magnesium, calcium, strontium, barium, aluminum and the like), salts of halide (salts of lithium, potassium, sodium, rubidium, calcium, magnesium, aluminum and the like), salts of water soluble oxides (salts of lithium, potassium, sodium, rubidium, calcium, magnesium, aluminum and the like) which are generally and widely used as supporting salts.

As the electrode, various ones can be used. Preferred examples of anodes are ITO (mixed oxide of indium oxide and tin oxide), platinum, gold, silver, glassy carbon, an electrically conductive metal oxide, an electrically conductive organic polymer and the like. Preferred examples of cathodes are base metals including aluminum, zinc, tin, iron, nickel, magnesium and the like, and alloys including stainless steel and the like. Besides the above, copper, platinum, gold, silver, glassy carbon, electrically conductive metal oxide, an electrically conductive organic polymer and the like, semiconductors, such as crystalline silicone, amorphous silicone and the like can be applied. Particularly, it is preferred to use a metal more noble than the oxidation-reduction potential (against +0.15 to +0.30V saturated calomel electrode) of ferrocene derivatives, or an electrically conductive substance. In the case of producing a photoconductor for electrophotography, aluminum, particularly aluminum substrate, is used as the cathode.

Conditions for electrotreatment in the present invention can be determined under the condition so that the thin film of above mentioned hydrophobic substance may be formed on the cathode. Therein the conditions that the thin film of said hydrophobic substance is formed on the cathode is not limited to the condition for forming a hydrophobic thin film only, but include the condition for forming hydrophobic thin films on both the cathode and the anode. Such conditions vary with circumstances, specifically, electrotreatment is performed with a potentiostat or with a galvanostat at the liquid temperature of 0° to 100° C. for the period of one minute to two hours. In the electrotreatment with a potentiostat, the potential on the cathode should be controlled to −0.03 to −10.0V and in the electrotreatment with a galvanostat, the current density should be controlled in the range of 1 $\mu A/cm^2$ to 100 $mA/cm^2$. Therein when the above ferrocene derivatives are used, the liquid temperature is 0° to 50° C., preferably 5 to 40° C., the potential of the cathode is −0.03 to −5.00V, preferably −0.05 to −2.00V. The current density should be 1 to 300 $\mu A/cm^2$, preferably 1 to 100 $\mu A/cm^2$. On the other hand, when surfactants other than ferrocene derivatives are used, the liquid temperature is room temperature to 100° C., the potential of the cathode is −0.5 to −10.0V, and the current density is 50 $\mu A/cm^2$ to 100 $mA/cm^2$, preferably 100 $\mu A/cm^2$ to 10 $mA/cm^2$.

On performing the electrotreatment in such conditions, environmental conditions of pH change drastically in the vicinity of the cathode, and as the result, the micelles becomes unstable, separate and scatter. Accompanying such a scattering of, hydrophobic substances dissolved in the solution come to deposit on the cathode, to form uniform thin films tightly sticking to the cathode.

The thin films obtained according to the process of the present invention are effectively subjected to, if necessary, post treatments such as electrowashing, solvent washing, and baking treatment at 100° to 300° C.

Since films are formed on the cathode according to the present invention, thin films of hydrophobic substances can be formed on base metals including aluminum, which are applicable to photosensitive materials and the like.

In addition, the process of the present invention can employ surfactants generally has used and a very high value in practical use.

The thin films formed according to the process of the present invention are extensively and effectively used as materials for optical disks, optical memory, photosensitive material, color filter, solar batteries, toners, pigments and the like.

Particularly, the photoconductor for electrophotography obtained by carrying out the present invention with the use of an aluminum substrate as the cathode, and charge carrier generation materials as the hydrophobic substance are extensively and effectively used for photosensitive drums for copiers, laser printers and the like.

To produce a photoconductor for electrophotography according to the process of the present invention, a charge carrier generation layer is formed on the cathode, as described before. On the formation of said charge carrier layer, it is effective to add an appropriate amount of binder polymer in the aqueous medium, if desired, to be included in the charge carrier generation layer to be formed, and heighten the mechanical strength of said layer. As the binder polymer to be used, poly(vinyl butyral), poly(methyl methacrylate), polyester, poly(vinylidene chloride), polyamide, styrene-maleic anhydride polymer and the like can be used.

Said photoconductor for electrophotography is formed fundamentally of base metals such as aluminum used as a cathode and thin films of a charge carrier generation layer formed on said base metal. If a charge carrier transport layer (CTL) is formed on it further, a still higher efficiency can be obtained. In forming said charge carrier transport layer, the process for producing thin films of the present invention may be employed or other processes (e.g., slip cast method, polymer binding method, deposition method and others) may be employed. As a charge carrier transport material used for forming said charge carrier transport layer, compounds such as indoline, quinoline, triphenylamine, bisazo, pyrazole, pyrazoline, oxidiazole, thiazole, imidazole, hydrazone, triphenylmethane, carbazole, benzaldehyde and the like or derivatives thereof, and polymers or copolymers containing these compounds or derivatives as substituents, or blends of the above compounds or derivatives and various polymer or copolymers can be used.

The, the present invention is described in greater detail with reference to the following examples and the comparative examples.

EXAMPLES 1 TO 9 AND COMPARATIVE EXAMPLES 1 TO 2

To 100 ml of water were added surfactants shown in Table 1 so that the concentration might become 2 mmol/L (L=liter) to obtain the solution. Then, to the solution was added hydrophobic powder having the specified average particle diameter to make 10 mM and the resulting mixture was stirred by ultrasonic waves for 10 minutes at 25° C., followed by stirring with a magnetic stirrer for 3 days.

The solution thus obtained was diluted to 1/25 in concentration and visible absorbance was measured to calculate the solubility from the value. The results are shown in Table 1. From Table 1, it can be seen that hydrophobic powder is sufficiently soluble (dispersed) in water.

Subsequently, an electrolyte was prepared by adding lithium bromide to the above pre-diluted solution (dispersion) to make 0.1 mol/L. By using this electrolyte, as well as by using aluminum or platinum as the reaction electrode (cathode), a platinum electrode as the opposite electrode (anode), applying the voltage at 25° C., controlled electric current electrolysis was carried out for 15 minutes so that an electric current density should become 0.2 mA/cm$^2$.

As the result, a thin film was formed on the aluminum (or platinum) substrate. On the aluminum (or platinum) substrate, on which this thin film was formed, a visible ray was irradiated and the reflection peak was measured. The results are shown in FIG. 1 to 9 corresponding to Example 1 to 9, respectively).

The reflection peak confirmed that the thin film on the aluminum (or platinum) substrate was made of phthalocyanine.

Further, a hydrophobic thin film could be formed by connecting the reference electrode (a saturated calomel electrode) to the above electrolyte, adjusting the potential of reaction electrode to 1.5 to 2.0V lower than the reference electrode and passing electricity (controlled potential electrolysis).

TABLE 1

Figure 2:
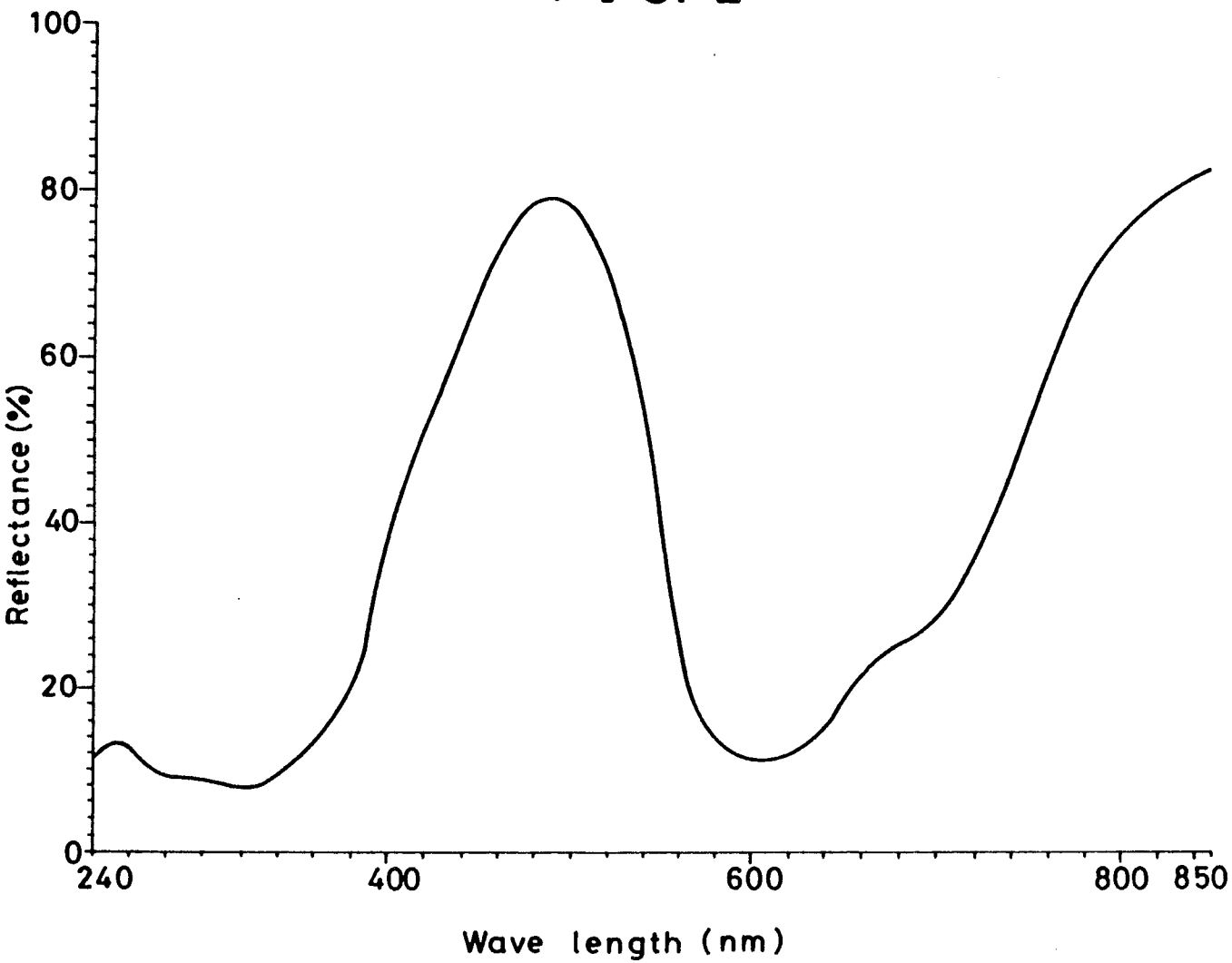
Figure 3:
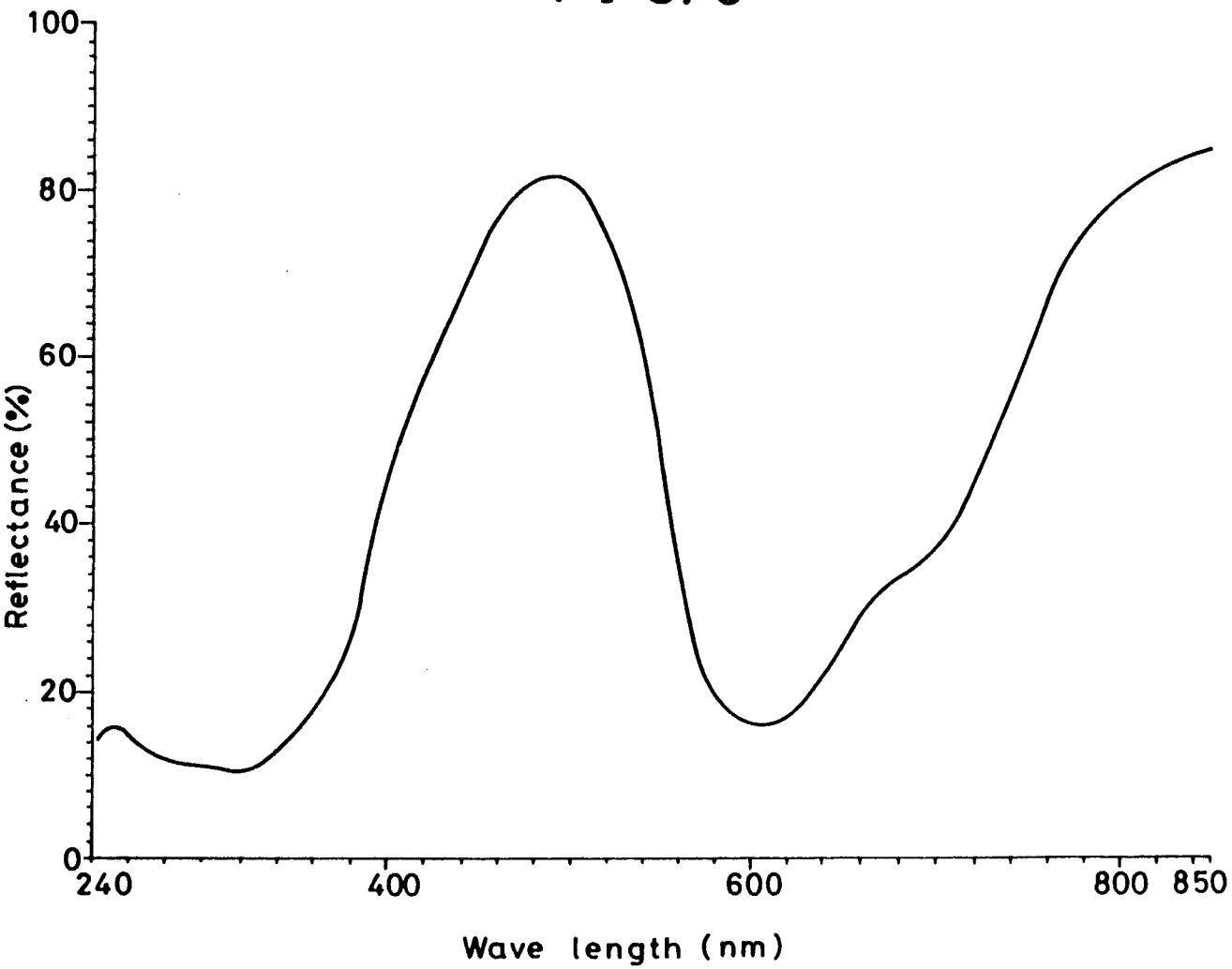
Figure 4:
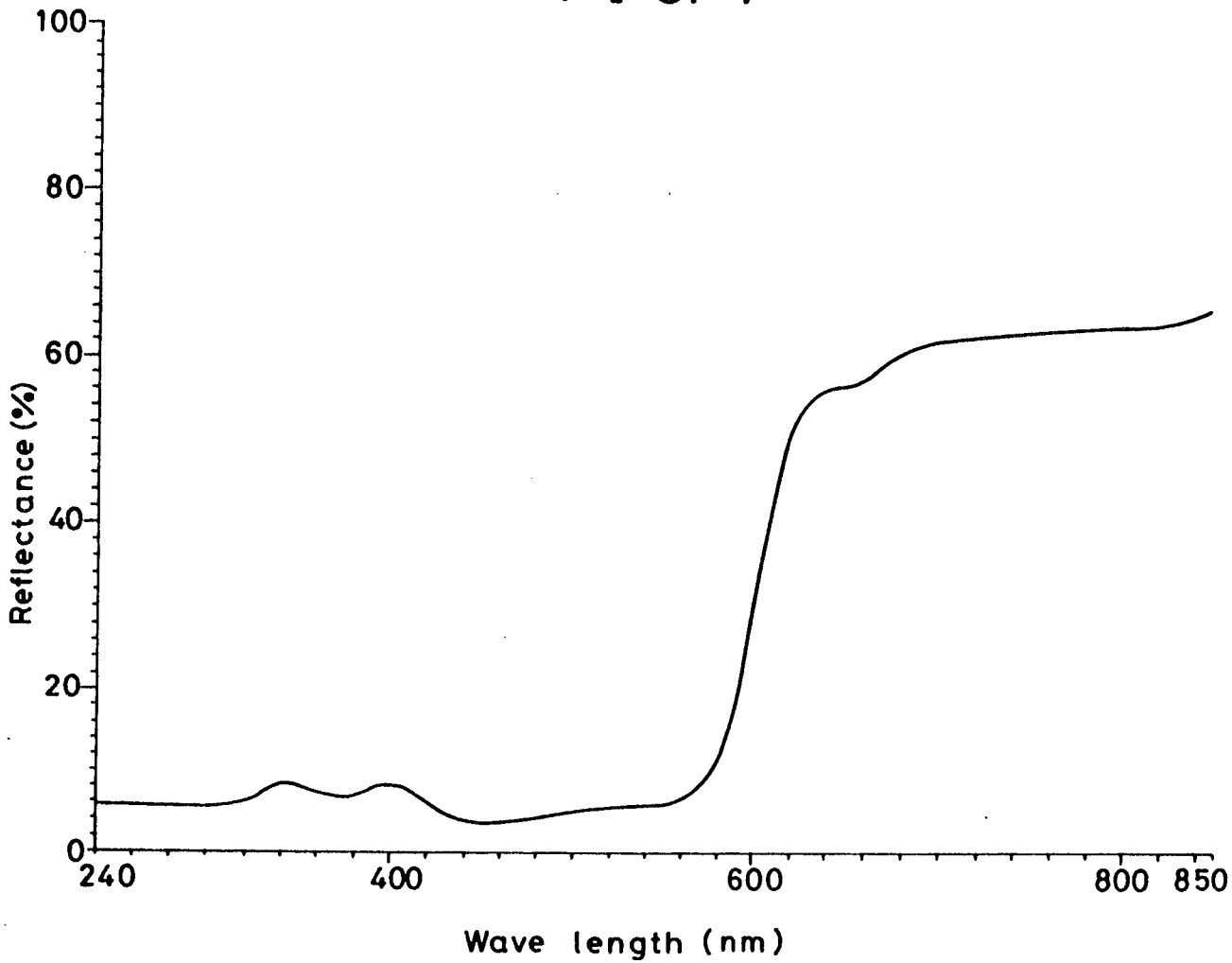
Figure 5:
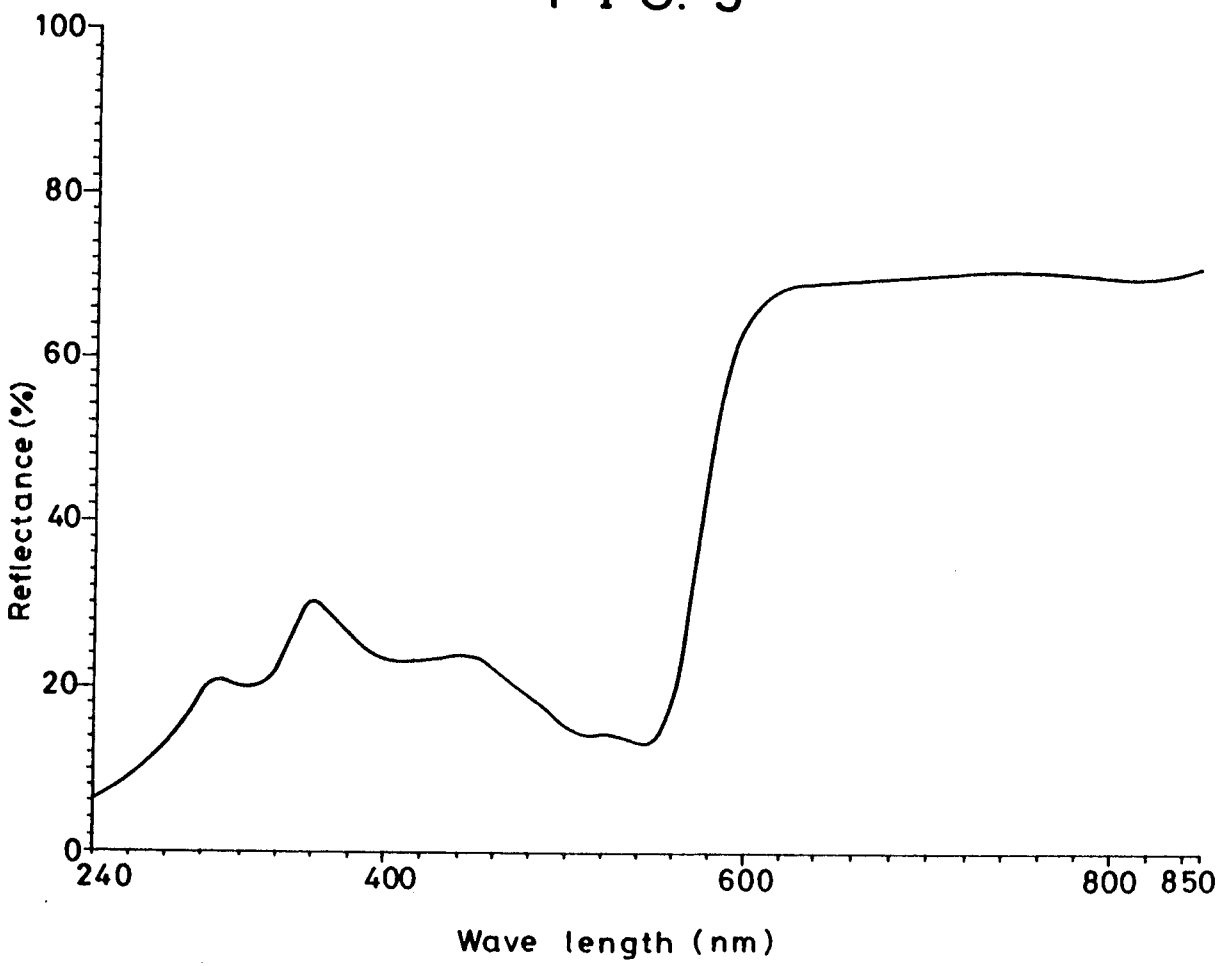
Figure 6:
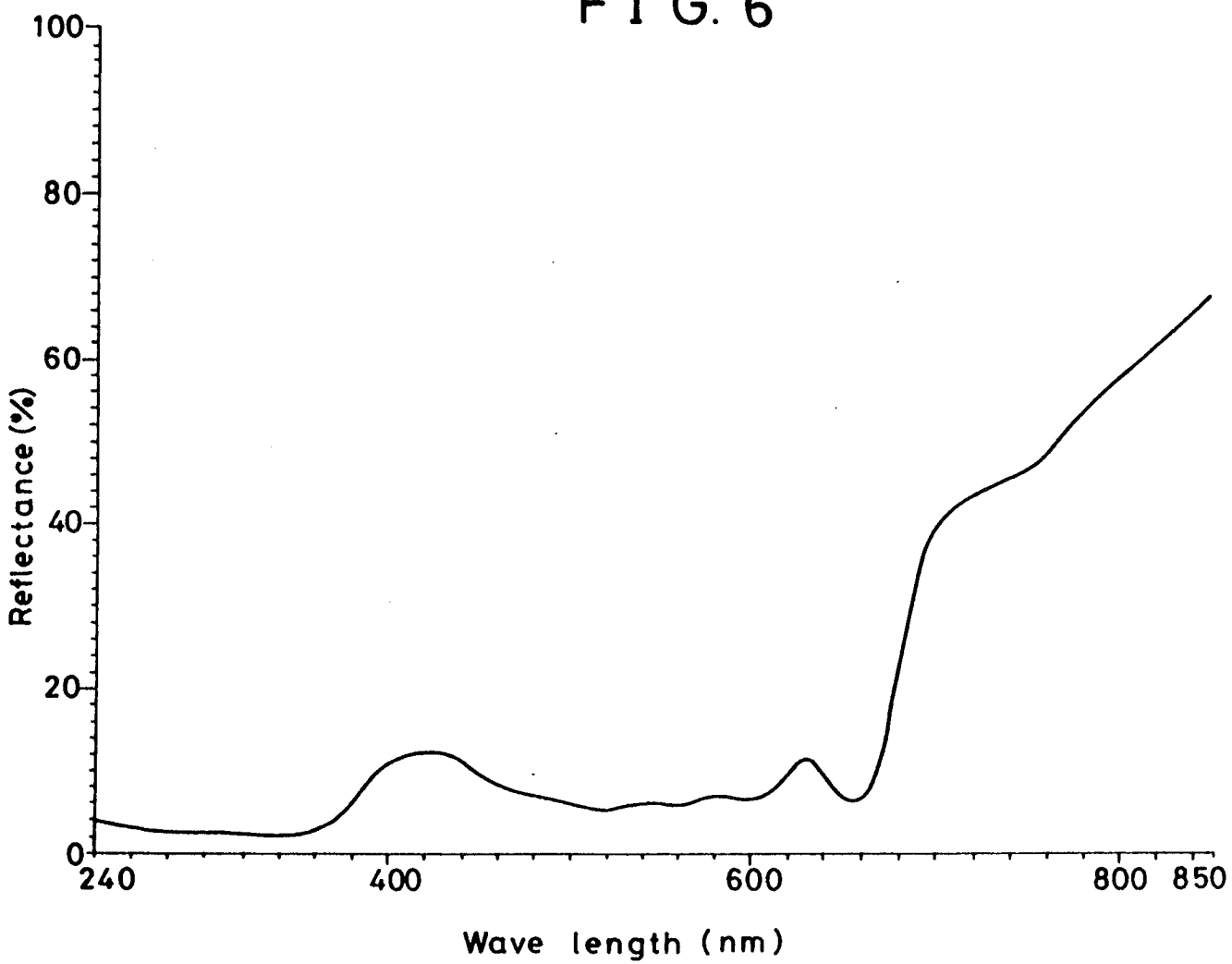
Figure 7:
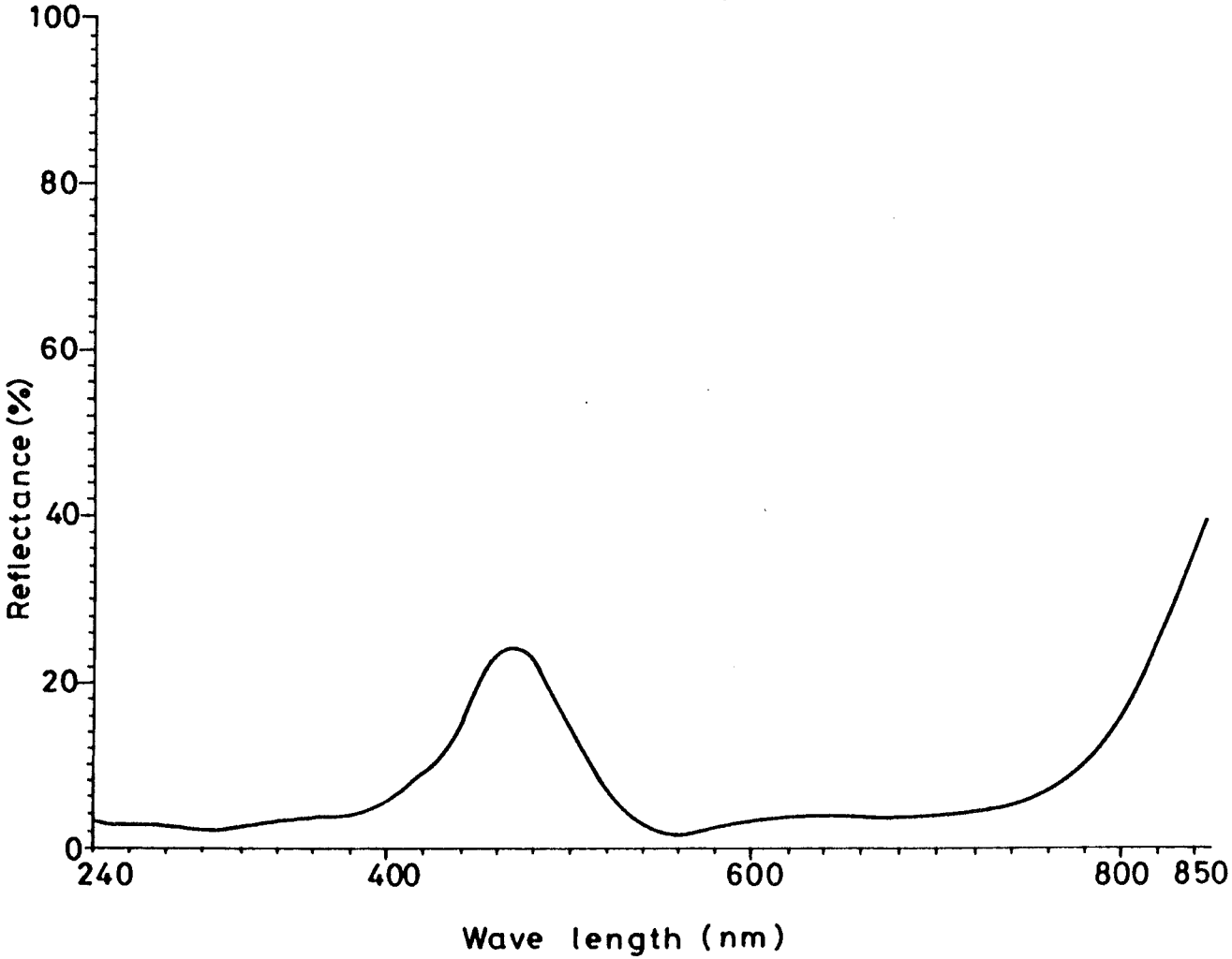
Figure 8:
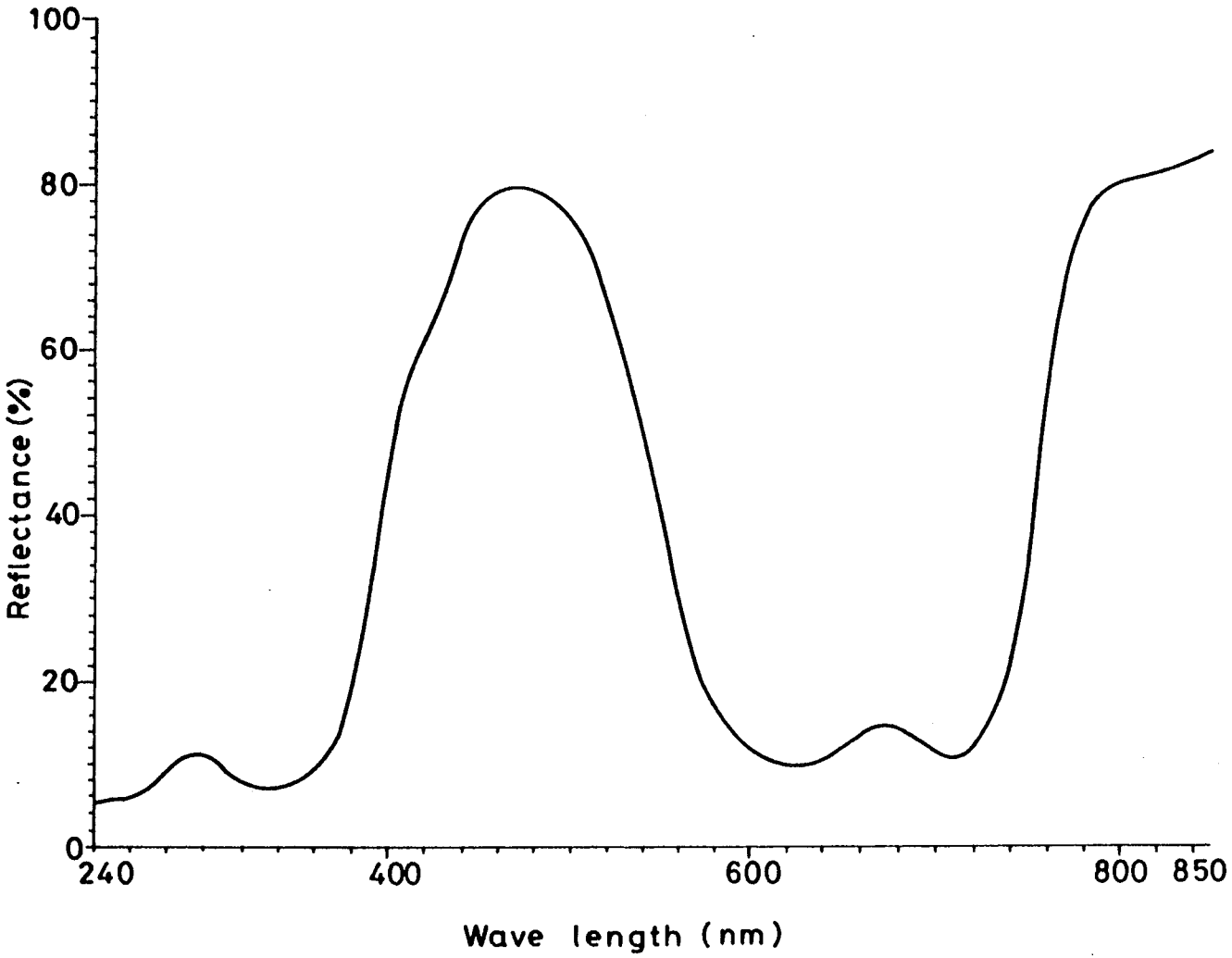
Figure 9:
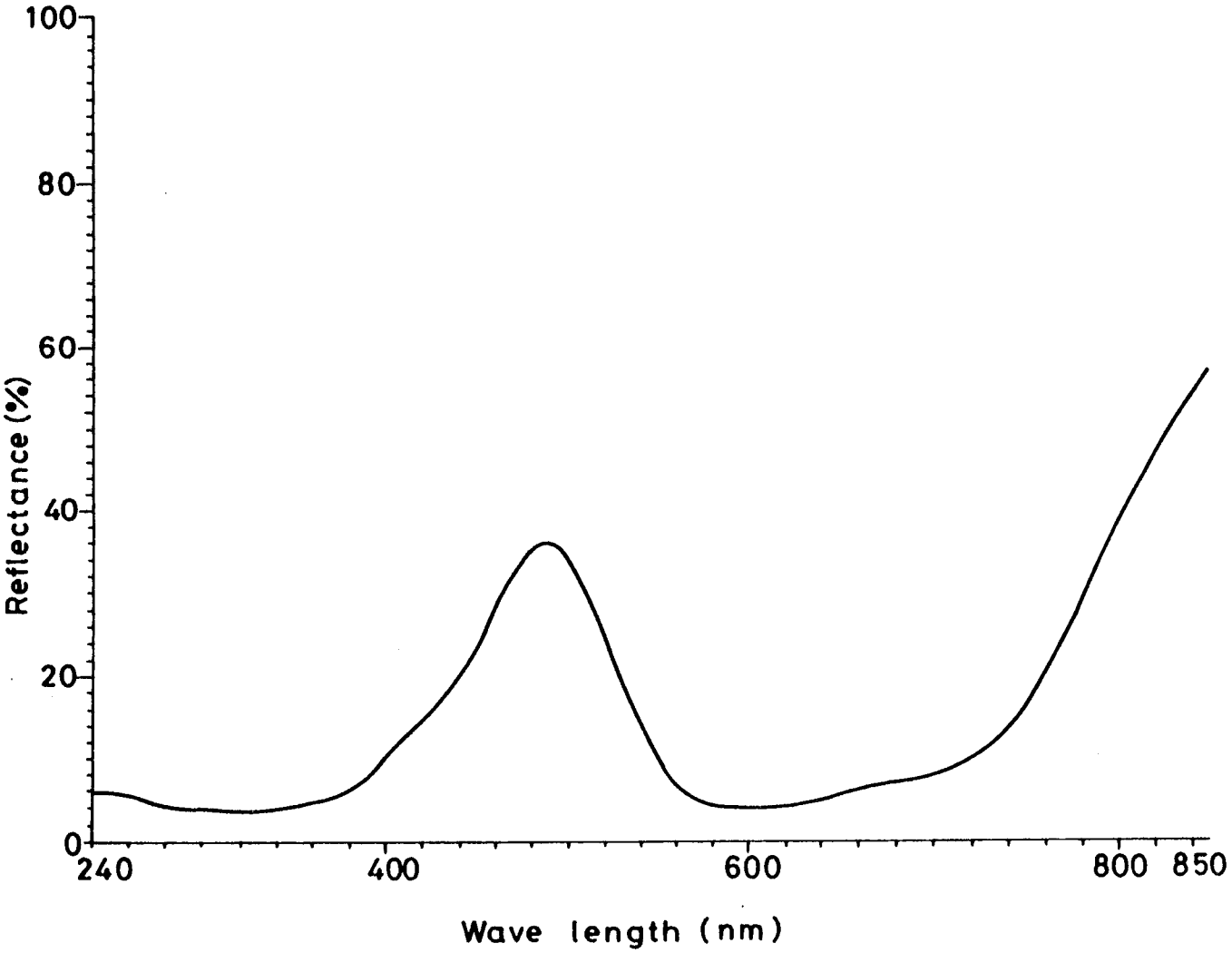

| NO. | Surfactant | HLB-value | Solubility*9 (mM) | Hydrophobic Material | Cathode | Electric Current Density (mA/cm$^2$) | Reflection Spectrum |
|---|---|---|---|---|---|---|---|
| Example 1 | Brij 35*1 | 10 or more | 4.2 | Phthalocyanine (0.22 μm) | Aluminum | 0.2 | FIG. 1 |
| Example 2 | Brij 35 | 10 or more | 4.2 | Phthalocyanine (0.22 μm) | Platinum | 0.1 | FIG. 2 |
| Example 3 | Brij 35 | 10 or more | 4.2 | Phthalocyanine (0.22 μm) | Aluminum | 0.1 | FIG. 3 |
| Example 4 | BL-25*2 | 19.5 | 5.4 | Paliogen Red K3580 (0.07 μm) | Aluminum | 0.1 | FIG. 4 |
| Example 5 | BC-23*3 | 18.0 | 5.2 | Lithol Scarlet K3700 (0.08 μm) | Aluminum | 0.1 | FIG. 5 |
| Example 6 | NP-10*4 | 18.0 | 5.6 | Tetraphenylporphyrin (0.26 μm) | Aluminum | 0.1 | FIG. 6 |
| Example 7 | MYL-10*5 | 12.5 | 1.5 | Heliogen Blue K6902 (0.12 μm) | Aluminum | 0.1 | FIG. 7 |
| Example 8 | Brij 35 | 10 or more | 4.2 | Copper phthalocyanine (0.19 μm) | Aluminum | 0.5 | FIG. 8 |
| Example 9 | TAMNS-10*6 | 10.0 | 4.9 | Phthalocyanine (0.18 μm) | Aluminum | 0.8 | FIG. 9 |
| Comparative Example 1 | MYS-4*7 | 6.5 | 0 | Phthalocyanine (0.22 μm) | Aluminum | Film not formed | — |
| Comparative Example 2 | NP-2*8 | 4.5 | 0 | Phthalocyanine (0.22 μm) | Aluminum | Film not formed | — |

*1Kao Co., Ltd.
*2Nikko Chemical Co., Ltd. Polyoxyethylenelaurylether
*3Nikko Chemical Co., Ltd. Polyoxyethylenecetylether
*4Nikko Chemical Co., Ltd. Polyoxyethylenenonylphenylether
*5Nikko Chemical Co., Ltd. Polyoxyethylenemonolaurate
*6Nikko Chemical Co., Ltd. Polyoxyethylenestearylamine
*7Nikko Chemical Co., Ltd. Polyethyleneglycolmonostearate
*8Nikko Chemical Co., Ltd. Polyethylenenonylphenylether
*9Shown as the concentration of hydrophobic material soluble in 2 mM surfactant

EXAMPLES 10 TO 13

To 100 ml of water were added nonionic surfactant (produced by Nikko Chemical Co., Ltd. polyoxyethylenenonylphenylether, HLB-value=18) so that the concentration might become 2 mmol/L to obtain the solution. Then, to the solution was added phthalocyanine (produced by Tokyo Kasei Co., Ltd.) having an average particule diameter of 0.22 μm (Examples 10 to 12) or copper phthalocyanine (produced by Tokyo Kasei Co., Ltd.) having an average particle diameter of 0.19 μm (Example 13) to make 10 mM and the resulting mixture was stirred by ultrasonic waves for 10 minutes at 25° C., followed by stirring with a magnetic stirrer for 3 days.

Then, the electrolyte was prepared by adding lithium bromide to the solution to make 0.1 mol/L. By using this electrolyte, as well as by using aluminum electrode as the reaction electrode (cathode) and ITO electrode as the opposite electrode (anode), applying the voltage at 25° C., a controlled electric current electrolysis was carried out so that the electric current density might become 0.1 to 0.2 mA/cm$^2$.

As the result, a thin film of phthalocyanine (Examples 10 to 12) or a thin film of copper phthalocyanine (Example 13) was formed on the aluminum substrate as the cathode.

The thin film of phthalocyanine or the thin film of copper phthalocyanine (charge carrier generation layer; CGL) was sufficiently washed with ethanol, dried and subjected to spincoating with chlorobenzene solution (concentration, 11 wt. %) of polyvinylcarbazole to form a charge carrier transport layer (CTL) having a thickness of 6 to 8 μm. Thus a, photoconductor was obtained containing CTL of polyvinylcarbazole, CGL of phthalocyanine (or copper phthalocyanine) and an aluminum electrode.

Further, the performance of the photoconductor was evaluated, using a test machine of SP428 type (manufactured by Kawaguchi Electric Co., Ltd.) as follows. That is, the above photoconductor was subjected to corona charge at −7.0 kV for 30 seconds and the surface of the photoconductor was charged negative.

Let the surface potential be Vd, and light with a wavelength of 610 nm or 630 nm was irradiated (output: 1 μW), and the period (seconds) in which the potential becomes half (½ Vd) was found. The luminous energy in that period (intensity of light × period, Unit: μJ/cm²) was an indication of the ability of the photoconductor to light with a wavelength of 610 nm or 630 nm. The results are shown in Table 2.

COMPARATIVE EXAMPLE 3

The photoconductor was prepared in the same manner as in Example 10 except that a thin film of phthalocyanine as a CGL was formed by the vacuum deposition method. The performance was evaluated in the same manner. The results are shown in Table 2.

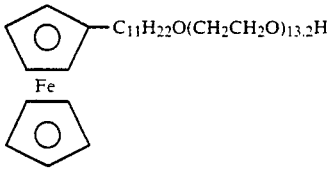

EXAMPLE 15

To 100 cc of water were added a micelle forming agent of a ferrocene derivative represented by the structural formula 2 to make 2 mM. To 20 cc of micelle solution were added 0.1 g of perylene-based pigment (K3580) (produced by BASF Co., Ltd.) and the resulting mixture was stirred by ultrasonic waves for 10 minutes to disperse and dissolve. After stirring with a stirrer 2 days and nights, there was obtained a dispersed and soluble micelle solution which was subjected to centrifugal separation for 30 minutes at 2000 rpm. A visible absorption spectrum of the supernatant confirmed that K3580 was dispersed.

To the dispersed and dissolved micelle solution was added lithium bromide to make 0.1M and such was stirred with a stirrer for 10 minutes. By using this solution as an electrolyte, as well as by using a platinum plate as the anode, an aluminum electrode as the cathode and a saturated calomel electrode as the reference electrode, a controlled potential electrolysis was carried out at 25° C., at the applied voltage of −0.8V, with an electric current density of 22.0 μA/cm² for 30 minutes. The amount of electric current was 0.03 C.

As the result, a thin film of K3580 was obtained on the aluminum electrode. Since the peak wavelength of reflection spectrum of Ke3580 on the aluminum electrode agreed with that of absorption spectrum of the dispersed and soluble micelle solution, it can be seen that the thin film on the aluminum electrode was K3580 and an electron microtomograph showed the thickness of the film was 0.4 μm.

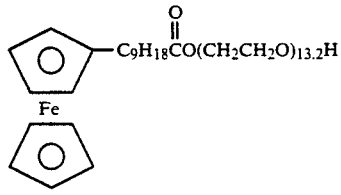

TABLE 2

| No. | Preparation Condition of CGL: Electrolysis Mode | Electric Current Density (mA/cm²) | Amount of Electric Current (C/cm²) | Material of CGL | Material of CTL | Vd (V) | Photosensitivity (exposure required for half decay of charge voltage) (μJ/cm²) |
|---|---|---|---|---|---|---|---|
| Example 10 | Constant Current | 0.2 | 0.13 | Phthalocyanine | Polyvinylcarbazole | −540 | 72 |
| Example 11 | Constant Current | 0.1 | 0.13 | Phthalocyanine | Polyvinylcarbazole | −490 | 60 |
| Example 12 | Constant Current | 0.1 | 0.13 | Phthalocyanine* | Polyvinylcarbazole | −500 | 40 |
| Example 13 | Constant Current | 0.2 | 0.13 | Copper Phthalocyanine | Polyvinylcarbazole | −470 | 60 |
| Comparative Example 3 | — | — | — | Phthalocyanine | Polyvinylcarbazole | −460 | 200 |

*CGL was washed with chloronaphthalene.

EXAMPLE 14

To 100 cc of water were added a micelle forming agent of a ferrocene derivative represented by the structural formula 1 to make 2 mM solution. To 20 cc of micelle solution were added 0.1 g of phthalocyanine and the resulting mixture was stirred by ultrasonic waves for 10 minutes to disperse and dissolve. After stirring with a stirrer 2 days and nights, there was obtained a dispersed and dissolved micelle solution which was subjected to centrifugal separation for 30 minutes at 2000 rpm. A visible absorption spectrum of the supernatant confirmed that phthalocyanine was dispersed.

To the dispersed and dissolved micelle solution was added lithium bromide to make 0.1M and such was stirred with a stirrer for 10 minutes. By using this solution as an electrolyte, as well as by using a platinum plate as the anode, an ITO glass electrode as the cathode and a saturated calomel electrode as the reference electrode, a controlled potential electrolysis was carried out at 25° C., at the applied voltage of −0.5V, with an electric current density of 11.0 μA/cm² for 30 minutes. The amount of electric current was 0.02 coulomb (C).

As the result, a thin film of phthalocyanine was obtained on the ITO transparent glass electrode. Since the absorption spectrum of phthalocyanine on the ITO transparent glass electrode agreed with that of the dispersed and soluble micelle solution, it can be seen that the thin film on the ITO transparent glass electrode was phthalocyanine and the thickness of the film was 0.6 μm from the absorbance.

EXAMPLE 16

To 100 cc of water were added a micelle forming agent of a ferrocene derivative represented by the structural formula 3 to make 2 mM. To 20 cc of micelle solution were added 0.1 g of copper phthalocyanine (produced by Dainichi Seika Co., Ltd.) and the resulting mixture was stirred by ultrasonic waves for 10 minutes to disperse and dissolve. After stirring with a stirrer 2 days and nights, there was obtained a dispersed and soluble micelle solution which was subjected to centrifugal separation for 30 minutes at 2000 rpm. A visible absorption spectrum of the supernatant confirmed that copper phthalocyanine was dispersed.

To the dispersed and dissolved micelle solution was added lithium bromide to make 0.1M and such was stirred with a stirrer for 10 minutes. By using this solution as an electrolyte, as well as by using a platinum plate as the anode, an aluminum electrode as the cathode and a saturated calomel electrode as the reference electrode, controlled potential electrolysis was carried out at 25° C., at the applied voltage of −0.3V, with an electric current density of 7.6 $\mu A/cm^2$ for 30 minutes. The amount of electric current was 0.015 C.

As the result, a thin film of copper phthalocyanine was obtained on the aluminum electrode. Since the peak wavelength of reflection spectrum of copper phthalocyanine on the aluminum electrode agreed with that of the absorption spectrum of the dispersed and soluble micelle solution, it can be seen that the thin film on the aluminum electrode was copper phthalocyanine and an electron microtomograph showed the thickness of the film was 0.25 $\mu$m.

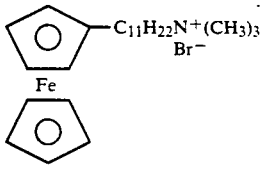

EXAMPLE 17

To 100 cc of water were added a micelle forming agent of ferrocene derivative represented by the structural formula 4 to make 2 mM. To 20 cc of micelle solution were added 0.1 g of viologen and the resulting mixture was stirred by ultrasonic waves for 10 minutes to disperse and dissolve. After stirring with a stirrer 2 days and nights, there was obtained a dispersed and soluble micelle solution which was subjected to centrifugal separation for 30 minutes at 2000 rpm. A visible absorption spectrum of the supernatant confirmed that viologen was dispersed.

To the dispersed and dissolved micelle solution was added lithium bromide to make 0.1M and such was stirred with a stirrer for 10 minutes. By using this solution as an electrolyte, as well as by using a platinum plate as the anode, a copper electrode as the cathode and a saturated calomel electrode as the reference electrode, a controlled potential electrolysis was carried out at 25° C., at the applied voltage of −0.7V, with an electric current density of 17.6 $\mu A/cm^2$ for 30 minutes. The amount of electric current was 0.03 C.

As the result, a thin film of viologen was obtained on the copper electrode. Since the peak wavelength of reflection spectrum of viologen on the copper electrode agreed with that of the absorption spectrum of the dispersed and soluble micelle solution, it can be seen that the thin film on the copper electrode was viologen an electron microtomograph showed and the thickness of the film was 0.65 $\mu$m.

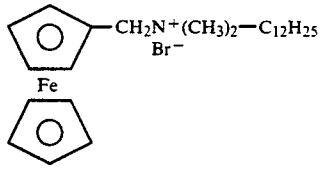

EXAMPLE 18

To 100 cc of water were added a micelle forming agent of a ferrocene derivative represented by the structural formula 5 to make 2 mM. To 20 cc of micelle solution was added 0.1 g of $CuPcC_{18}Br_8$ (L9361) (produced by BASF Co., Ltd.) and the resulting mixture was stirred by ultrasonic waves for 10 minutes to disperse and dissolve. After stirring with a stirrer 2 days and nights, there was obtained a dispersed and soluble micelle solution which was subjected to centrifugal separation for 30 minutes at 2000 rpm. A visible absorption spectrum of the supernatant confirmed that L9361 was dispersed.

To the dispersed and dissolved micelle solution was added lithium bromide to make 0.1M and such was stirred with a stirrer for 10 minutes. By using this solution as an electrolyte, as well as by using a platinum plate as the anode, a polyaniline/ITO electrode as the cathode and a saturated calomel electrode a as the reference electrode, controlled potential electrolysis was carried out at 25° C., at the applied voltage of −0.7V, with an electric current density of 11.3 $\mu A/cm^2$ for 30 minutes. The amount of electric current was 0.02 C.

As the result, a thin film of L9361 was obtained on the polyaniline/ITO electrode. Since the peak wavelength of the reflection spectrum of L9361 on the polyaniline/ITO electrode agreed with that of the absorption spectrum of the dispersed and soluble micelle solution, it can be seen that the thin film on the polyaniline/ITO electrode was L9361 and an electron microtomograph showed the thickness of the film was 0.6 $\mu$m.

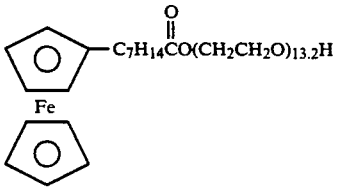

EXAMPLE 19

To 100 cc of water were added a micelle forming agent of a ferrocene derivative represented by the structural formula 6 to make 2 mM. To 20 cc of the micelle solution were added 0.1 g of Sudan I and the resulting mixture was stirred by ultrasonic wave for 10 minutes to disperse and dissolve. After stirring with a stirrer 2 days and nights, the dispersed and dissolved micelle solution obtained was subjected to centrifugal separation for 30 minutes at 2000 rpm. A visible absorption spectrum of the supernatant confirmed that Sudan I was dispersed.

To the dispersed and soluble micelle solution was added lithium bromide to make 0.1M and such was stirred with a stirrer for 10 minutes. By using this solution as an electrolyte, as well as by using a platinum plate as the anode, a stainless electrode as the cathode and a saturated calomel electrode as the reference electrode, a controlled potential electrolysis was carried out at 25° C., at the applied voltage of −0.5V, with an electric current density of 8.6 $\mu A/cm^2$ for 30 minutes. The amount of electric current was 0.01 C.

As the result, a thin film of Sudan I was obtained on the stainless electrode. Since the peak wavelength of the reflection spectrum of Sudan I on the stainless electrode agreed with that of the absorption spectrum of the dispersing and dissolving micelle solution, it can be seen that the thin film on the stainless electrode was Sudan I and an electron microtomograph showed the thickness of the film was 0.2 $\mu m$.

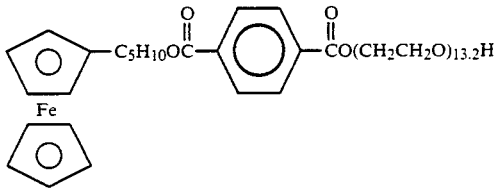

EXAMPLE 20

To 100 cc of water were added micelle forming agent of ferrocene derivative represented by the structural formula 7 to make 2 mM. To 20 cc of micelle solution were added 0.1 g of tetraphenylporphyrin zinc complex (Zn-TPP) and the resulting mixture was stirred by ultrasonic waves for 10 minutes to disperse and dissolve. After stirring with a stirrer 2 days and nights, the dispersed and dissolved micelle solution obtained was subjected to centrifugal separation for 30 minutes at 2000 rpm. A visible absorption spectrum of the supernatant confirmed that Zn-TPP was dispersed.

To the dispersed and dissolved micelle solution was added lithium bromide to make 0.1M and it was stirred with a stirrer for 10 minutes. By using this solution as an electrolyte, as well as by using a platinum plate as the anode, a platinum electrode as the cathode and a saturated calomel electrode as the reference electrode, a controlled potential electrolysis was carried out at 25° C., at the applied voltage of −0.6V, with an electric current density of 17.2 $\mu A/cm^2$ for 30 minutes. The amount of electric current was 0.03 C.

As the result, a thin film of Zn-TPP was obtained on the platinum electrode. Since the peak wavelength of the reflection spectrum of Zn-TPP on the platinum electrode agreed with that of the absorption spectrum of the dispersed and dissolved micelle solution, it can be seen that the thin film on the platinum electrode was Zn-TPP and an electron microtomograph showed the thickness of the film was 0.18 $\mu m$.

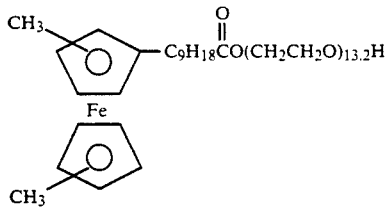

EXAMPLE 21

To 100 cc of water were added a micelle forming agent of a ferrocene derivative represented by the structural formula 8 to make 2 mM. To 20 cc of micelle solution were added 0.1 g of triphenylamine and the resulting mixture was stirred by ultrasonic waves for 10 minutes to disperse and dissolve. After stirring with a stirrer 2 days and nights, there was obtained a dispersed and soluble micelle solution which was subjected to centrifugal separation for 30 minutes at 2000 rpm. A visible absorption spectrum of the supernatant confirmed that triphenylamine was dispersed.

To the dispersed and soluble micelle solution was added lithium bromide to make 0.1M and such was stirred with a stirrer for 10 minutes. By using this solution as an electrolyte, as well as by using a platinum plate as the anode, an aluminum electrode as the cathode and a saturated calomel electrode as the reference electrode, a controlled potential electrolysis was carried out at 25° C., at the applied voltage of −0.9V, with an electric current density of 25.3 $\mu A/cm^2$ for 30 minutes. The amount of electric current was 0.04 C.

As the result, a thin film of triphenylamine was obtained on the aluminum electrode. Since the peak wavelength of the reflection spectrum of triphenylamine on the aluminum electrode agreed with that of the absorption spectrum of the dispersed and soluble micelle solution, it can be seen that the thin film on the aluminum electrode was triphenylamine and an electron microtomograph showed the thickness of the film was 0.45 $\mu m$.

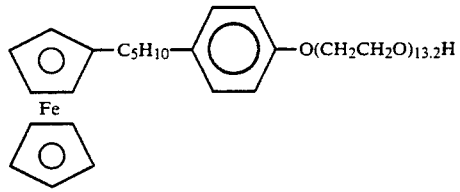

EXAMPLE 22

To 100 cc of water were added a micelle forming agent of a ferrocene derivative represented by the structural formula 9 to make 2 mM. To 20 cc of micelle solution was added 0.1 g of lake pigment (K3700) (BASF Co., Ltd.) and the resulting mixture was stirred by ultrasonic waves for 10 minutes to disperse and dissolve. After stirring with a stirrer 2 days and nights, there was obtained a dispersed and soluble micelle solution which was subjected to centrifugal separation for 30 minutes at 2000 rpm. A visible absorption spectrum of the supernatant confirmed that K3700 was dispersed.

To the dispersed and dissolved micelle solution was added lithium bromide to make 0.1M and such was stirred with a stirrer for 10 minutes. By using this solution as an electrolyte, as well as by using a platinum plate as the anode, a glassy carbon (GC) electrode as the cathode and a saturated calomel electrode as the reference electrode, a controlled potential electrolysis was carried out at 25° C., at the applied voltage of −0.8V, with an electric current density of 12.8 μA/cm2 for 30 minutes. The amount of electric current was 0.25 C.

As the result, a thin film of K3700 was obtained on the GC electrode. Since the peak wavelength of the reflection spectrum of K3700 on the GC electrode agreed with that of the absorption spectrum of the dispersed and soluble micelle solution, it can be seen that the thin film on the GC electrode was K3700 and an electron microtomograph showed the thickness of the film was 0.4 μm.

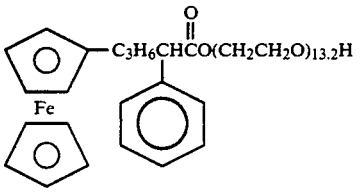

EXAMPLE 23

To 100 cc of water were added a micelle forming agent of a ferrocene derivative represented by the structural formula 10 to make 2 mM. To 20 cc of micelle solution were added 0.1 g of naphthol AS and the resulting mixture was stirred by ultrasonic waves for 10 minutes to disperse and dissolve. After stirring with a stirrer 2 days and nights, the dispersed and dissolved micelle solution obtained was subjected to centrifugal separation for 30 minutes at 2000 rpm. A visible absorption spectrum of the supernatant confirmed that naphthol AS was dispersed.

To the dispersed and soluble micelle solution was added lithium bromide to make 0.1M and such was stirred with a stirrer for 10 minutes. By using this solution as an electrolyte, as well as by using a platinum plate as the anode, an ITO glass electrode as the cathode and a saturated calomel electrode as the reference electrode, a controlled potential electrolysis was carried out at 25° C., at the applied voltage of −0.5V, with an electric current density of 5.5 μA/cm² for 30 minutes. The amount of electric current was 0.01 C.

As the result, a thin film of naphthol AS was obtained on the ITO glass electrode. Since the peak wavelength of the absorption spectrum of naphthol AS on the ITO glass electrode agreed with that of the absorption of the dispersed and dissolved micelle solution, it can be seen that the thin film on the ITO glass electrode was naphthol AS and an electron microtomograph showed the thickness of the film was 0.4 μm.

Structural formula 10:

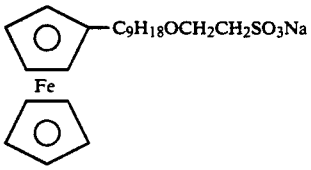

What is claimed is:

1. A process for producing a thin film comprising forming a charge carrier generation layer by electrotreating a dispersion or a solution obtained by dispersing or dissolving a hydrophobic substance powder, said substance being a charge carrier generation substance, said dispersion or solution containing a surfactant having a HLB value of 10.0 to 20.0 to form a thin film of said hydrophobic substance on a cathode, wherein the powder has an average particle diameter of not more than 10 μm.

2. The process for producing a thin film of claim 1, wherein the surfactant is a ferrocene compound and a thin film of said substance on the cathode is formed at a liquid temperature of 0° to 50° C., a potential on the cathode of −0.3 to −5.0V, and a current density of 1 to 300 μA/cm².

3. The process for producing a thin film of claim 1, wherein the surfactant is a compound other than a ferrocene compound, and a thin film of said substance on the cathode is formed at a liquid temperature of room temperature of 100° C., a potential on the cathode of −0.5 to −10.0V, and a current density of 50 μA/cm² to 100 mA/cm².

4. The process for producing a thin film of claim 1, wherein the surfactant is selected from the group consisting of polyoxyethylenealkylether, polyoxyethylene fatty acid ester, polyoxyethylene alkylphenylether, alkyltrimethylammonium chloride and fatty acid diethylaminoethyamide.

5. The process for producing a thin film of claim 1, wherein the cathode is a base metal.

6. The process for producing thin films of claim 1, wherein the cathode is made of aluminum.

7. The process of producing a thin film of claim 1, wherein the average particle diameter is 1 to 0.01 μm and the powder is dispersed or dissolved in an aqueous medium.

8. The process for producing a thin film of claim 1, which further comprises forming a charge carrier transport layer on said charge carrier generation layer, said charge carrier transport layer comprising a compound selected from the group consisting of indoline, quinoline, triphenylamine, bisazo, pyrazole, pyrazoline, oxidiazole, thiazole, imidazole, hydrazone, triphenylmethane, carbazole and benzaldehyde.

9. The process of claim 8, wherein the charge carrier generation layer comprises phthalocyanine and the charge carrier transfer layer comprises polyvinylcarbazole.

10. A process for producing a thin film comprising forming a charge carrier generation layer by electrotreating a dispersion or a solution obtained by dispersing or dissolving a hydrophobic substance powder, said substance being a charge carrier generation substance, said dispersion or solution containing a surfactant having a HLB value of 10.0 to 20.0 to form a thin film of said hydrophobic substance on a cathode, wherein the surfactant is a micelle forming agent comprising a ferrocene compound.

11. The process for producing a thin film of claim 10, wherein the surfactant is a ferrocene compound and a thin film of said substance on the cathode is formed at a liquid temperature of 0° to 50° C., a potential on the cathode of −0.3 to −5.0V, and a current density of 1 to 300 μA/cm².

12. The process for producing a thin film of claim 10, wherein the surfactant is a compound other than a ferrocene compound, and a thin film of said substance on the cathode is formed at a liquid temperature of room temperature of 100° C., a potential on the cathode of −0.5 to −10.0V, and a current density of 50 $\mu A/cm^2$ to 100 $mA/cm^2$.

13. The process for producing a thin film of claim 10, wherein the cathode is made of aluminum.

14. The process for producing a photoconductor for electrophotography, which comprises forming a charge carrier generation layer by dispersing or dissolving a hydrophobic substance powder, said substance being a charge carrier generation substance, said powder having an average particle diameter of not more than 10 μm in an aqueous medium with a surfactant having a HLB value of 10.0 to 20.0, said surfactant is a compound other than a ferrocene compound, and subsequently electrotreating the resulting dispersion or solution with an aluminum electrode as a cathode, to form a thin film of said hydrophobic substance on said aluminum electrode.

15. The process of claim 14, wherein the surfactant is selected from the group consisting of polyoxyethylene alkylether, polyoxyethylene fatty acid ester, polyoxyethylene alkylphenylether, alkyltrimethylammonium chloride and fatty acid diethylaminoethylamide.

16. The process of claim 14, which further comprises forming a charge carrier transport layer on said charge carrier generation layer, said charge carrier transport layer comprising a compound selected from the group consisting of indoline, quinoline, triphenylamine, bisazo, pyrazole, pyrazoline, oxidiazole, thiazole, imidazole, hydrazone, triphenylmethane, carbazole and benzaldehyde.

17. The process of claim 16, wherein the charge carrier generation layer comprises phthalocyanine and the charger carrier transfer layer comprises polyvinylcarbazole.

18. A process for producing a thin film comprising forming a charge carrier generation layer by electrotreating a dispersion or a solution obtained by dispersing or dissolving a hydrophobic substance powder, said substance being a charge carrier generation substance, said dispersion or solution containing a surfactant having a HLB value of 10.0 to 20.0 to form a thin film of said hydrophobic substance on a cathode, wherein the surfactant is a ferrocene compound and a thin film of said substance on the cathode is formed at a liquid temperature of 0° to 50° C., a potential on the cathode of −0.3 to −5.0V, and a current density of 1 to 300 $\mu A/cm^2$ and, wherein the ferrocene compound is of the formula

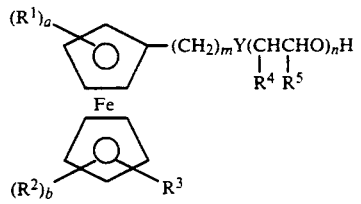

(I)

wherein $R^1$ and $R^2$ are each an alkyl group having no more than 6 c carbon atoms, an alkoxy group having no more than 6 carbon atoms, an amino group, a dimethylamino group, a hydroxyl group, an acetyl amino group, a carboxyl group, a methoxycarbonyl group, an acetoxyl group, an aldehyde group and a halogen, $R^3$ is a hydrogen or a straight chain or branched alkyl or alkenyl group having 4 to 18 carbon atoms, each of $R^4$ and $R^5$ is a hydrogen or a methyl group, Y is an oxygen or an oxycarbonyl group, a is an integer from zero to 4, b is an integer from zero to 4, m is an integer from 1 to 18 and n is a real number from 2 to 70.

19. The process for producing a thin film of claim 18, wherein the surfactant has a HLB value of 12 to 18.

20. The process for producing a thin film of claim 19, wherein the surfactant is in a concentration of 10 μm to 1M.

21. The process for producing a thin film of claim 20, wherein the thin film is formed at a liquid temperature of 5° to 40° C., a potential of the cathode of −0.05 to −2.00V, and a current density of 1 to 100 $\mu A\ cm^2$; the cathode is aluminum; and the powder has an average particle diameter of 1 to 0.01 μm.

* * * * *

UNITED STATES PATENT AND TRADEMARK OFFICE

CERTIFICATE OF CORRECTION

PATENT NO. : 5,122,247

DATED : June 16, 1992

INVENTOR(S) : KOKADO et al

It is certified that error appears in the above-identified patent and that said Letters Patent is hereby corrected as shown below:

Title page, Section [30] Foreign Application Priority Data:

Replace Japanese application "63-3176626" with --63-317626--.

Section [56] References Cited, right column, under "FOREIGN PATENT DOCUMENTS", insert the following references:

| | | |
|---|---|---|
| 63-243298 | 10/1988 | Japan |
| WO89/01939 | 3/1989 | World Int. Prop. Office |

Column 16, line 16 (claim 2), replace "-0.3 to -5.0V" with -- -0.03 to -5.0V --.

Column 16, line 22 (claim 3), following "temperature", replace "of" with -- to --.

Column 16, lines 29-30 (claim 4), replace "die-"thylaminoethyamide" with --diethylaminoethylamide--.

Column 16, line 65 (claim 11), replace "-0.3 to -5.0V" with -- -0.03 to -5.0V --.

Column 17, line 36 (claim 17), replace "charger" with --charge--.

UNITED STATES PATENT AND TRADEMARK OFFICE

CERTIFICATE OF CORRECTION

PATENT NO. : 5,122,247

DATED : June 16, 1992

INVENTOR(S) : KOKADO et al

It is certified that error appears in the above-identified patent and that said Letters Patent is hereby corrected as shown below:

Column 18, line 4 (claim 18), replace "-0.3 to -5.0V" with -- -0.03 to -5.0V --.

Column 18, line 19 (claim 18), delete "c" after "6".

Signed and Sealed this

Twelfth Day of October, 1993

*Attest:*

*Attesting Officer*

BRUCE LEHMAN

*Commissioner of Patents and Trademarks*